United States Patent [19]

Ikeda et al.

[11] Patent Number: 4,862,711

[45] Date of Patent: Sep. 5, 1989

[54] DETERGENT DISPENSING SYSTEM FOR CLOTHES WASHING MACHINE OR THE LIKE

[75] Inventors: Yoshio Ikeda; Fumio Torita, both of Aichi, Japan

[73] Assignee: Kabushiki Kaisha Toshiba, Kawasaki, Japan

[21] Appl. No.: 251,988

[22] Filed: Sep. 29, 1988

Related U.S. Application Data

[63] Continuation of Ser. No. 12,207, Feb. 6, 1987.

[30] Foreign Application Priority Data

Feb. 15, 1986 [JP] Japan ..... 61-31405
Jun. 4, 1986 [JP] Japan ..... 61-129714

[51] Int. Cl.[4] ..... D06F 39/02
[52] U.S. Cl. ..... 68/12 R; 68/17 R
[58] Field of Search ..... 68/17 R, 12 R, 207; 134/93; 222/52, 63, 639, 642, 643, 651, 652

[56] References Cited

U.S. PATENT DOCUMENTS

| | | | |
|---|---|---|---|
| 2,159,559 | 5/1939 | Lawyer | 222/643 |
| 3,826,113 | 7/1974 | Noraas et al. | 68/17 R |
| 4,009,598 | 3/1977 | Bernard et al. | 68/17 R |
| 4,207,995 | 6/1980 | Neely | 222/231 |
| 4,429,817 | 2/1984 | Ikeda | 68/17 R X |
| 4,503,575 | 3/1985 | Knoop et al. | 68/17 R |
| 4,691,850 | 9/1987 | Kirschmann | 222/642 |

FOREIGN PATENT DOCUMENTS

| | | | |
|---|---|---|---|
| 65209 | 11/1982 | European Pat. Off. | 68/17 R |
| 42-18769 | 9/1967 | Japan . | |
| 54-43827 | 12/1979 | Japan . | |
| 2128640 | 5/1984 | United Kingdom | 68/17 R |

*Primary Examiner*—Philip R. Coe
*Assistant Examiner*—Stephen F. Gerrity
*Attorney, Agent, or Firm*—Foley & Lardner, Schwartz, Jeffery, Schwaab, Mack, Blumenthal & Evans

[57] ABSTRACT

A detergent dispensing system for clothes washing machines consists of a detergent containing hopper having a detergent discharging passageway having the section of approximately semicircular configuration and formed at the bottom portion, a spiral coil arranged in the detergent discharging passageway and discharging the powdered detergent contained in the hopper by screw action caused by its rotation so that the powdered detergent is dispensed to a wash tub of a clothes washing machine, an electric motor for driving the coil, a first manually operated switch for inputting data of a kind of the powdered detergent to be dispensed, a second manually operated switch for inputting data of degree of soil of clothes to be washed, a third manually operated switch for inputting data of a water level to set the water level in the wash tub, and a controller for controlling the rotation speed of the coil so that the amount of the powdered detergent to be dispensed takes a value in accordance with the kind of the powdered detergent, the degree of soil of the clothes to be washed and the water level the data of which are supplied from the first, second and third manually operated switches respectively.

6 Claims, 8 Drawing Sheets

DETERGENT DISPENSING SYSTEM FOR CLOTHES WASHING MACHINE OR THE LIKE

This application is a continuation of application Ser. No. 012,207, filed Feb. 6, 1987.

BACKGROUND OF THE INVENTION

1. Field of the Invention

The present invention generally relates to a system for automatically dispensing a powdered detergent into a wash tub of a clothes washing machine or the like, and more particularly to such a system which can provide automatic control of an amount of detergent to be dispensed in accordance with kinds of detergents and so on.

2. Description of the Prior Art

One of the detergent dispensing systems of the above-mentioned type is disclosed in Japanese patent application No. 54-43,827, wherein a certain amount of a powdered detergent contained in a container provided at an upper portion of the washing machine is dispensed into a wash tub by a predetermined amount every time when a valve is opened. According to this system, the valve is manually operated, which entails troublesome manual operation.

Another detergent dispensing system is disclosed in Japanese patent application No. 42-18,769 wherein the powdered detergent contained in the container is dispensed into the wash tub with a screw rotated by a water-driven wheel provided in a water supply passageway through which the water is introduced into the wash tub. According to this construction, the provision of screw denecessitates manual operation of the valve and the detergent is dispensed in accordance with an amount of water to be supplied to the wash tub. However, there are some kinds of detergents, for example, the detergents are mainly divided into a synthetic one and a powdered soap, each of which has some different kinds on the point of degrees of concentration. Furthermore, degree of soil differs from clothes to clothes. In these circumstances, the aforementioned prior art detergent dispensing systems could not provide desirable control of the amount of detergent in accordance with different kinds of detergents and degree of soil of the clothes to be washed. The need thus remains to provide a detergent dispensing system wherein the amount of detergent to be dispensed is determined in accordance with the kind of detergent and degree of soil of the clothes to be washed.

SUMMARY OF THE INVENTION

It is therefore an object of the present invention to provide an improved detergent dispensing system for the clothes washing machine or the like, wherein desirable results can be obtained from the washing machine or the like in spite of the fact that the detergents differ in kinds and that degree of soil differs from clothes to clothes.

It is another object of the present invention to provide an improved detergent dispensing system for the clothes washing machine or the like, wherein the detergent can be prevented from being excessively dispensed.

In order to attain the above-described objects, the detergent dispensing system of this invention comprises a means for discharging a powdered detergent contained in a hopper as a detergent container to an area communicating to the wash tub, a control means for controlling the operation of the detergent discharging means and a manually operated switch for supplying the control means with data of a kind of detergent, which data is input by manual operation of the switch. The control means controls the operation of the detergent discharging means in accordance with the data of the kind of detergent so that an amount of detergent to be dispensed takes one of predetermined values in accordance with the kind of the detergent.

According to the present invention, desirable results can be obtained from the clothes washing machine in spite of the fact that different kinds of detergents are used. Also use of excessive amounts of detergent can be effectively prevented.

According to another aspect of the present invention, the detergent dispensing system incorporates an operation switch for inputting data pertaining to the degree of soil of the clothes to be washed in place of or together with the data pertaining to the kind of detergent, whereby the amount of detergent to be dispensed is controlled so as to be a proper amount in accordance with the degree of soil of the clothes. In this aspect, the proper amount of detergent is also determined in accordance with the degree of soil of the clothes to be washed, so that the desirable results can also be obtained.

These and other objects and many attendant advantages of the present invention will be readily appereciated by referring to the following description of a preferred embodiment and claims, taken in conjunction with accompanying drawings.

DESCRIPTION OF A PREFERRED EMBODIMENT

Figure 1:
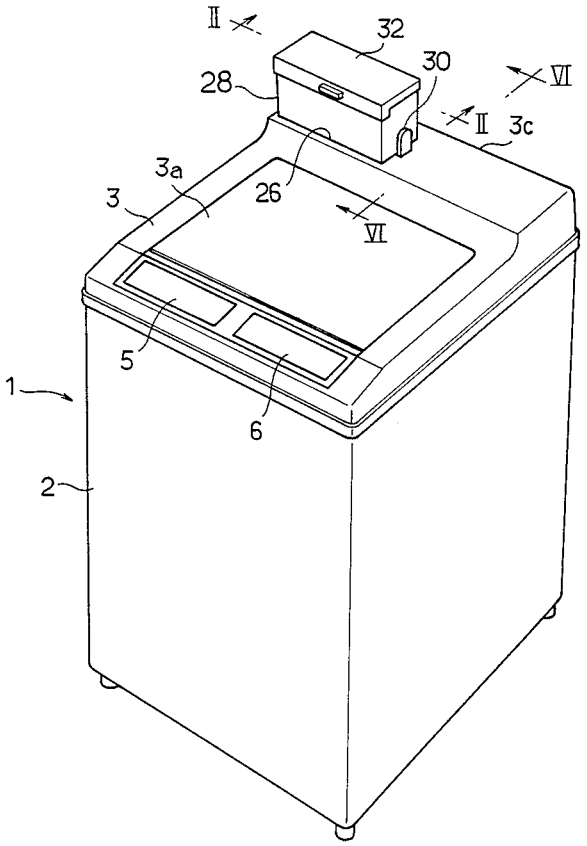
FIG. 1 is a perspective view of a clothes washing machine incorporating the detergent dispensing system in accordance with the present invention.
Figure 6:
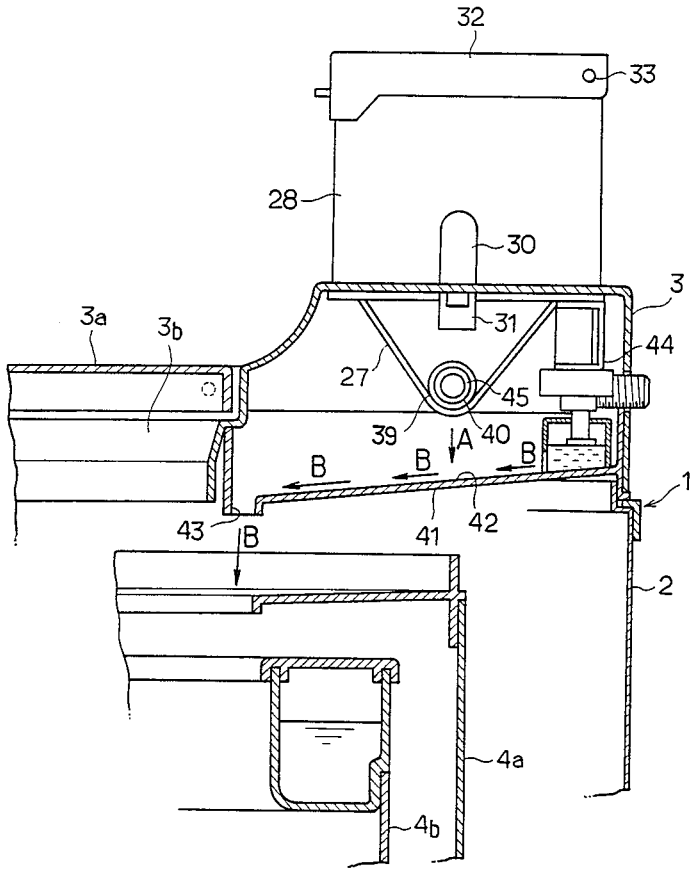
FIG. 6 is a fragmentary enlarged longitudinal section taken along line VI—VI in FIG. 1.

Referring now to the drawings, there is shown in FIG. 1 a clothes washing machine of the top-loading type incorporating the detergent dispensing system in accordance with this invention. An appearance cabinet 1 comprises a side wall 2 and an upper cover 3. As shown in FIG. 6, an outer tube **4*a*, an inner wash tub 4*b* for centrifugally extracting wash liquid from clothes, and a drive mechanism for driving vanes (not shown) for wash liquid agitation are provided within the cabinet 1. An opening 3*b* is formed in the upper cover 3 and an access lid 3*a*** is hingedly mounted for opening and closing so that the clothes are loaded and unloaded through the opening 3*b*. The construction, so far as described, is identical with those of the prior art washing machines.

Figure 3:
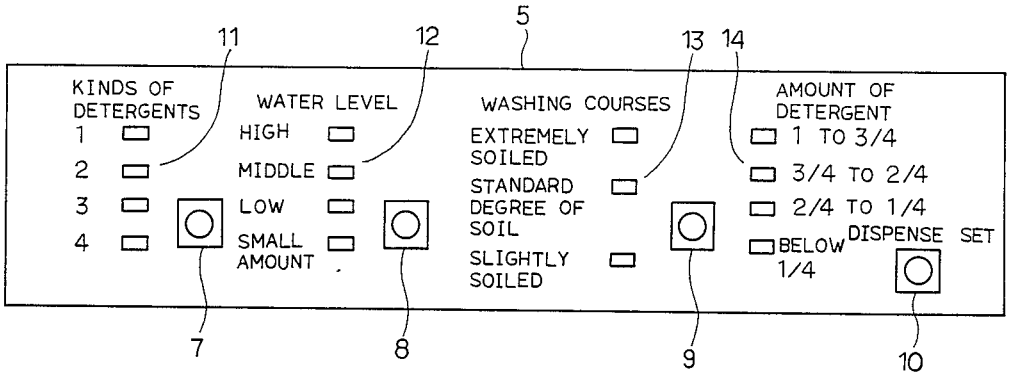
FIGS. 3 and 4 are enlarged plan views of first and second operation panels respectively provided in the clothes washing machine in FIG. 1.
Figure 4:
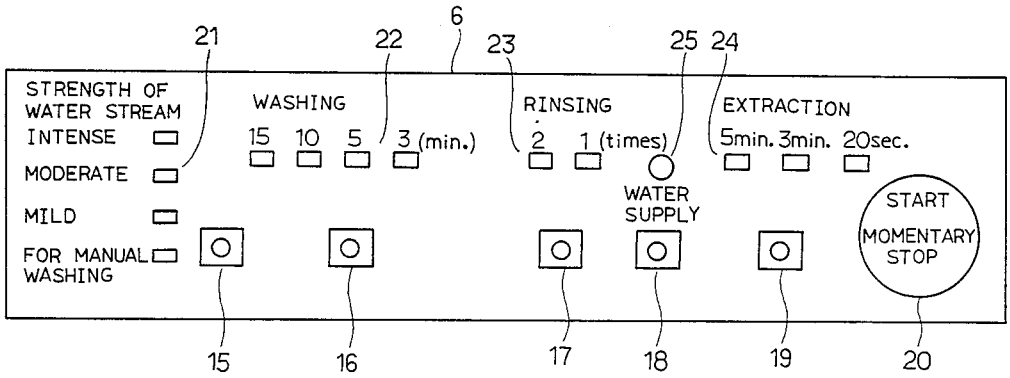

First and second operation panels 5 and 6 are provided in the forward edge portion of the upper cover 3. As shown in FIG. 3, the first operation panel 5 includes a switch 7 for inputting data relating to the kind of a powdered detergent to be dispensed, a switch 8 for setting a desired level of water to be supplied into the wash tub 4*b*, a switch 9 for inputting data relating to the degree of soil of clothes to be washed and a switch 10 for inputting data relating to an initial amount of the powdered detergent contained in a hopper 28 which will be described in detail hereafter. Displays 11 through 13, each comprising a plurality of light-emitting diodes, are provided in the vicinity of respective switches 7–10. The light-emitting diodes of each display are sequentially illuminated every time the respective switches are operated, thereby indicating respective data contents input or set with the switches 7–10. The second operation panel 6 includes a switch 15 for setting the strength of the wash liquid stream in the washing operation, a switch 16 for setting a time period of the washing operation, a switch 17 for setting a number of the rinse operation times, a switch 18 for starting the supply of wash water to the wash tub 4*b*, a switch 19 for setting a time period of the liquid extracting operation and a switch 20 for selectively starting the operation of the washing machine or momentarily interrupting the operation thereof. See FIG. 4. Displays 21 through 24 each comprising one or more light-emitting diodes are respectively provided in the left-hand side of the switch 15 and the portions in the vicinity of the switches 16, 17 and 19. A display 25 comprising a light-emitting diode is provided in the vicinity of the switch 18. The light-emitting diodes of each of the displays 21–24 are sequentially illuminated every time each of the switches 15–19 are operated, thereby indicating respective data contents.

Figure 2:
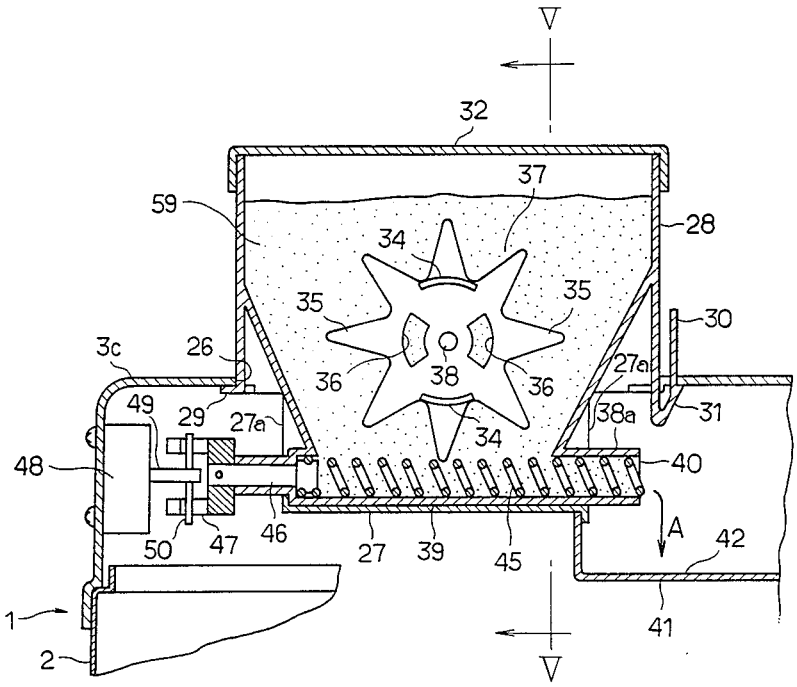
FIG. 2 is an enlarged longitudinal section taken along line II—II in FIG. 1.
Figure 5:
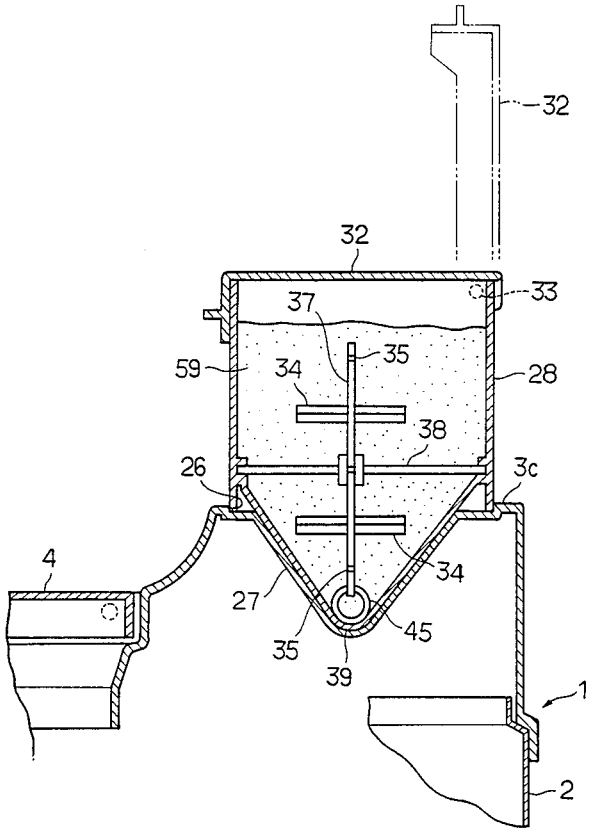
FIG. 5 is an enlarged longitudinal view taken along line V—V in FIG. 2.

A trapezoidal portion 3*c* is formed on the rearward portion of the upper cover 3 and a hopper set opening 26 is formed on the left side of the trapezoidal portion 3*c* as shown in FIGS. 2 and 5. A hopper support 27 adjacent to the periphery of the hopper set opening 26 is formed integrally with the trapezoidal portion 3*c* and extends downwardly. The hopper support 27 has a generally V-shaped section as shown in FIG. 5 and both side edges 27*a* thereof are open as shown in FIG. 2. The hopper 28 is a detergent container having a generally V-shaped section corresponding to that of the hopper support 27 and inclined side edges, and is inserted through the hopper set opening 26 and mounted on the hopper support 27. When the hopper 28 is mounted, a claw 29 formed at the lower end of the left side wall of the hopper 28 is engaged with the left peripheral edge of the hopper set opening 26 as shown in FIG. 2 and a resilient claw 31 having a working strip 30 is resiliently engaged with a right peripheral edge of the opening 26 so that the hopper 28 is prevented from being unpreparedly detached. A hopper lid 32 is mounted on a rod 33 for rotative movement thereabout as shown in FIG. 5. A detergent agitating means 37 comprises a plurality of arc-shaped projections 34 extending forwardly and rearwardly within the hopper 28, a plurality of peripherally extending projections or blades 35 and a plurality of openings 36. The detergent agitating means 37 is rotatively mounted on a shaft 38 provided between the forward and rearward walls of the hopper 28. A detergent discharging passageway 39 having a generally semicircular bottom configuration is provided at the lower edge portion of the hopper 28 along a cylindrical portion 38*a* extending outwardly to the right from inside the hopper 28 as shown in FIG. 2. An outlet 40 of the passageway 39 faces a detergent reservoir portion 42 which corresponds to approximately central portion of the upper surface of a receiver plate 41 provided within the trapezoidal portion 3*c*. In order that the upper surface of the receiver plate 41 also serves as a water supply passageway, the plate 41 is inclined downwardly toward the end thereof facing the upper opening of the wash tub 4*b* provided within the cabinet 1. A detergent dispensing outlet 43 is formed at the lower end of the plate 41 and a water supply valve 44 is provided at the upper end of the plate 41. A nonexpansive and non-contacting spiral coil 45 as a detergent discharging member is provided in the detergent discharging passageway 39 for rotative movement over its entire length and one of the projections 35 of the detergent agitating member 37 abuts the spiral coil 45. A transmission shaft 46 is inserted into the end of the passageway 39 opposite to the outlet 40 and connected to the end of the coil 45 at one end thereof. A coupling 47 is secured to the other end of the transmission shaft 46. An electric motor 48 is mounted on the inner left side wall of the trapezoidal portion 3*c* so as to be opposed to the coupling 47, as shown in FIG. 2. A transmission pin 50 is secured on the end of a rotation axis 49 so as to be perpendicular to the rotation axis 49 of the motor 48 and detachably engaged with the coupling 47.

Figure 7:
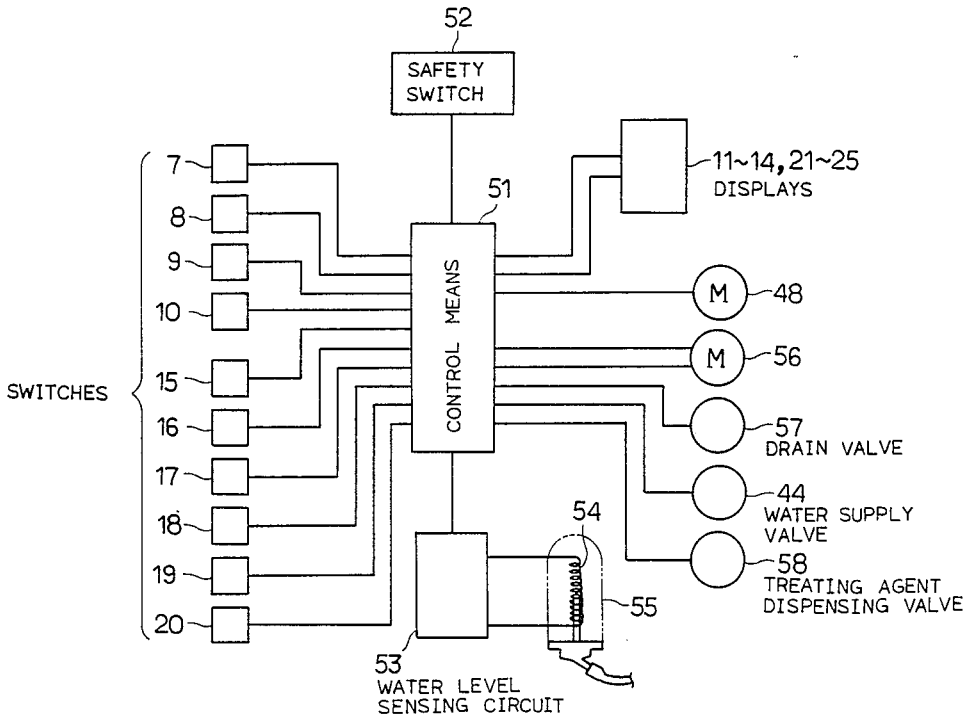
FIG. 7 is a block diagram illustrating the electrical connection between the control means and other parts.

Referring now to FIG. 7, numeral 51 designates a means for controlling the operation of the clothes washing machine, which control means 51 comprises a microcomputer. The switches 7–10 and switches 15–20 are connected to the input terminals of the control means 51. Output terminals of a safety switch 52 responsive to abnormal or unwanted vibration of the outer tub 4a and a water level sensing circuit 53 are also connected to the input terminals of the control means 51. The water level sensing circuit 53 is connected to a water level sensor 55 which changes inductances of the coil 54 in response to the water level in the wash tub 4b. Output terminals of the control means 51 are connected to the displays 11–14 and 21–25, the motor 48, a wash tub drive motor 56, a drain valve 57, the water supply valve 44 and a treating agent dispensing valve 58. A storage unit incorporated in the control means 51 has a first data table for storing data of detergent feed amount in accordance with different degrees of detergency of detergents to be contained in the hopper 2, a second data table for storing data of detergent feed amount in accordance with different degrees of soil of clothes to be washed, and a third data table for storing data of detergent feed amount in accordance with different water levels in the inner wash tub 4*b*.

Operation of the detergent dispensing system of the present invention will now be described. The hopper lid 32 of the hopper 28 is opened to the position shown in alternate long and two short dashes line in FIG. 5. The powdered detergent 59 is then put into the hopper 28 and the lid 32 is closed. The switch 10 is operated so that one of the light-emitting diodes of the display 14 is illuminated to indicate the amount of powdered detergent 59 put into the hopper 28, thereby storing the data of the initial amount of the powdered detergent 59 at the control means 51. The switch 7 is operated so that one of the light-emitting diodes of the display 11 is illuminated to thereby indicate the kind of the powdered detergent 59. The switch 8 is then operated so that one of the lightemitting diodes of the display 12 is illuminated to thereby indicate the water level. The switch 9 is operated so that one of the light-emitting diodes of the display 13 is illuminated to thereby indicate the degree of soil of the clothes to be washed. After the data of the kind of the powdered detergent 59, the water level and the degree of soil of the clothes to be washed are thus stored at the control means 51 respectively, a switch 20 is operated so that the washing operation is started. Upon operation of the switch 20 the motor 48 is automatically energized before the starting of the washing action. Rotation of the motor 48 is transmitted from the axis 49 to the transmission shaft 46 through an engagement structure comprising the transmission pin 50 and the coupling 47. The rotation of the motor 48 is further transmitted from the transmission shaft 46 to the spiral coil 45, thereby rotating the coil 45. The powdered detergent 59 is fed along the detergent discharging passageway 39 toward the outlet 40 by screw action of the coil 45. The powdered detergent 59 falls in the direction of arrow A is FIGS. 2 and 6 onto the detergent reservoir portion 41 of the plate 42. When the washing action is automatically started after the powdered detergent 59 is thus discharged to the reservoir portion 41, the powdered detergent 59 is carried away toward the dispensing outlet 43 by the water supplied through the water supply valve 44 in the direction of arrows B in FIG. 6 and dispensed into the wash tub **4*b***.

Before the starting of washing action of the clothes washing machine, the data of kind of the powdered detergent 59 is stored at the control means 51 by the operation of the switch 7. The data of the water level in the wash tub **4*b* is stored at the control means 51 by operation of the switch 8. The data of degree of soil of the clothes to be washed is stored at the control means 51 by operation of the switch 9. In this embodiment, the control means 51 reads out three kinds of data of detergent feed amount from the respective data tables of the storage unit, based on data of detergency, data of degree of soil of clothes, and data of water level inputted with the switches 7, 9 and 8 respectively, thereby controlling a turn-on time period or number of revolutions of the motor 48** so that an amount of detergent determined based on the three kinds of data of detergent feed amount is dispensed.

determined unit amount S in accordance with the water level by any one of constants A1–A4 in accordance with the kind of powdered detergent 59 the data of which is stored at the control means 51 with the switch 7 and any one of constants B1–B3 in accordance with the degree of soil of the clothes the data of which is stored at the control means 51 with the operation of the switch 9. The arithmetic operation is automatically performed by the control means 51. TABLE 1 shows one example of relation to determine the necessary amount of the powdered detergent 59. According to TABLE 1, when "HIGH" water level (approximately 48 liters of water) for clothes of 3 to 4 kg to be washed is set, the unit amount S of the powdered detergent 59 becomes approximately 20 g. In this case, when the powdered detergent 59 is a synthetic one and of a concentrated type, the constant A1 is selected in accordance with the data input by operation of the switch 7. Furthermore, when the degree of soil of the clothes to be washed is high, the constant B1 is selected in accordance with the data input by operation of the switch 9. Thus, the necessary amount of the powdered detergent 59 is determined by the equation, $S \times A1 \times B1$, that is, the necessary amount of the powdered detergent 59 is gained as $20 \times 2 \times 1.2 = 48$ g. In other cases, the necessary amount of the powdered detergent to be dispensed is also determined by the equation, $S \times Ai \times Bj$ (where $i = 1, 2, 3$ and $4$, $j = 1, 2$ and $3$).

Figure 8:
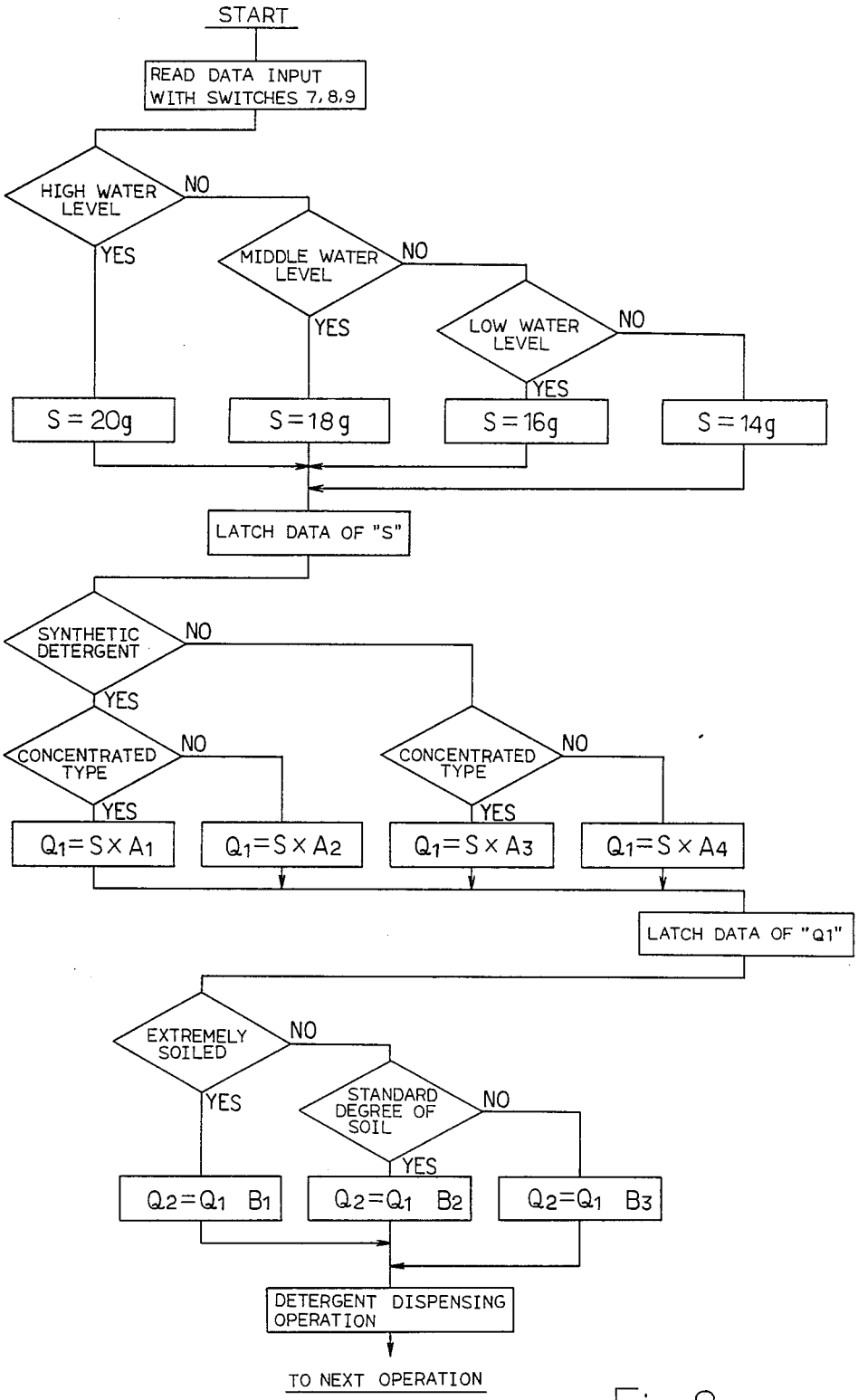
FIG. 8 is a flow chart illustrating the selection of the amount of detergent to be dispensed.

The electric circuits for performing the arithmetic operation to determine the necessary amount of the powdered detergent and for controlling the drive time period or rotation speed of the motor are readily realized by employing well-known technology of microcomputer incorporated controlling equipments. FIG. 8 is a flow chart showing an operation of the control means 51 to determine the necessary amount of powdered detergent 59.

Figure 9:
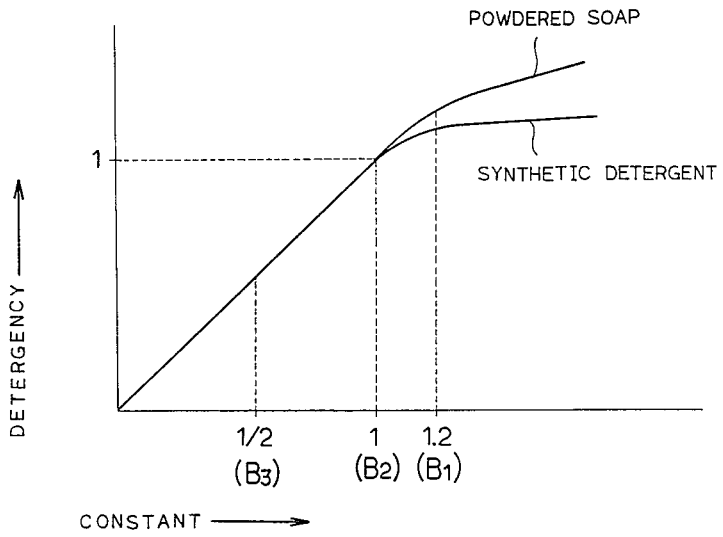
FIG. 9 is a graph showing the relation between the amount of detergent to be dispensed and detergency.

FIG. 9 shows the relationship between values of the constants B1, B2 and B3 representing the degrees of soil of the clothes to be washed and the detergency. According to FIG. 9, it is preferable that the constant B1 takes the value of 1.2 from the standpoints of efficiency, economy and so on.

When the switch 9 is operated to indicate the degree of soil of the clothes, the control means 51 operates so as to change the modes of the washing operation, for example, when the clothes are extremely soiled, the time period of the washing operation is lengthened or agi-

TABLE 1

| | | | Kinds of detergents | | | | | | |
|---|---|---|---|---|---|---|---|---|---|
| | | | A1 = 2 A2 = 3.2 Synthetic detergent | | A3 = 3.2 A4 = 4 Powdered Soap | | Washing courses (or degrees of soil of clothes) | | |
| Proper amount of clothes | Water level (Amount of water to be supplied) | Unit amount of detergent (S) (in round numbers) | Concentrated type (S) × 2 (in round numbers) | Standard type (S) × 3.2 (in round numbers) | Concentrated type (S) × 3.2 (in round numbers) | Standard type (S) × 4 (in round numbers) | B1 = 1.2 Extremely soiled | B2 = 1 Standard degree of soil | B3 = ½ Slightly soiled |
| 3 to 4 kg | "HIGH" level (48 l) | 20 g | 40 g | 64 g | 64 g | 80 g | | | |
| 2 to 3 kg | "MIDDLE" level (43 l) | 18 g | 36 g | 57 g | 57 g | 72 g | | | |
| 1 to 2 kg | "LOW" level (38 l) | 16 g | 32 g | 51 g | 51 g | 63 g | × 1.2 | × 1 | × ½ |
| below 1 kg | "SMALL AMOUNT" level (33 l) | 14 g | 28 g | 44 g | 44 g | 55 g | | | |

As shown in Table 1, the necessary amount of powdered detergent 59 is determined by multiplying a pretated wash liquid stream is intensified as compared with the case where the clothes are slightly soiled. When the clothes are slightly soiled, the time period of the washing operation is shortened or intensity of the wash liquid stream is decreased as compared with the case where the clothes are extremely soiled.

In the above described embodiment, one of the lighte-mitting diodes of the display 14 indicating the initial amount of powdered detergent is flushed to thereby warn an operator when the detergent 59 in the hopper 28 is decreased below a fourth of its entire amount. Alternatively, the light-emitting diodes may be illuminated sequentially from the one indicating the initial amount of the powdered detergent 59 contained in the hopper 28 and the light-emitting diode indicating that the amount of detergent left in the hopper 28 has been descreased below a fourth of the entire amount may finally be flushed.

In the detergent dispensing operation, the water supply valve 44 operates so that the water is started to be supplied through the valve 44 before the detergent 59 falls onto the plate 42 and that the water supply is continued even after the dispensing of the powdered detergent 59 is completed, thereby preventing the detergent 59 from directly affixing on the clothes. Consequently, the clothes are prevented from fading into yellowish colors or being deteriorated. Furthermore, the powdered detergent 59 is carried away without affixing on the surface of the plate 42.

The spiral coil 45 is rotated with one of the projections 35 sequentially engaging it. The powdered detergent 59 is thus agitated and prevented from becoming lumpy, thereby facilitating the feeding of the powdered detergent 59 to the detergent discharging passageway 39. Furthermore, the hopper 28 can readily be detached together with the coil 45 with the coupling 47 disconnected from the transmission pin 50 by disengaging the resilient claw 31 from the peripheral edge of the hopper set opening 26 by operation of the strip 30 to thereby pull the resilient claw 31 out and disengaging the claw 29 from the peripheral edge of the hopper set opening 26 to thereby pull the claw 31 out. The coil 45 and the hopper 28 are readily cleaned with water and so on.

The construction that the hopper 28 is readily detachable, however, does not constitute the present invention, and accordingly the hopper 28 may be fixed in position. The dispensing of the detergent may be performed separately from the supplying of the wash water. The water supply period of time may not be controlled and the detergent agitating member 37 may be eliminated. Furthermore, the detergent 59 may directly be dispensed to the wash tub without being carried through the passageway 39. The detergent feeding member is not limited to the spiral coil 45 and the prior art valve or screw may be employed. The motor 48 as a means for driving the detergent discharging member may be replaced by an electromagnet and so on. Although the kind of detergent and the degree of soil of the clothes are factors to determine the amount of powdered detergent in the above-described embodiment, either of them may be the factor.

Although the present invention has been described with a certain degree of particularity, it is understood that the present disclosure has been made only by way of example and that numerous changes in the details of construction and the combination and arrangement of parts may be resorted to without departing from the scope and spirit of the invention. Thus, the scope of the invention should not be limited by the foregoing description, but rather, only by the scope of the claims appended hereto.

What is claimed is:

1. A detergent dispensing system for a clothes washing machine, comprising:

(a) a single detergent container for selectively containing one of a plurality of kinds of powdered detergents which differ from one another in degree of detergency;

(b) discharging means associated with the single detergent container so that a powdered detergent contained in the detergent container is discharged to an area communicating to a washing member while in a washing operation;

(c) driving means for driving said discharging means so that said discharging means performs a detergent discharging operation;

(d) a manually operated switch operatively associated with a plurality of displays corresponding to the detergency degrees of the plurality of powdered detergents to be selectively contained in the detergent container, said manually operated switch generating a signal in accordance with a desirable detergency degree when any one of the displays is selected; and (e) control means comprising a microcomputer provided with a storage unit having a data table for storing data of detergent feed amount in accordance with the respective degrees of detergency of the detergents to be selectively contained in said detergent container, said microcomputer operating to read out said data from the data table in response to the signal supplied thereto from the manually operated switch, thereby controlling the driving means so that an amount of detergent defined by the data read out is discharged.

2. A detergent dispensing system for clothes washing machine or the like as set forth in claim 1, wherein said detergent discharging means comprises a coil member which is provided in a detergent discharging passageway for discharging the powdered detergent in the axial direction by screw action caused by rotation thereof when said detergent discharging means is driven by a drive means.

3. A detergent dispensing system for a clothes washing machine, comprising:

(a) a single detergent container for selectively containig one of a plurality of kinds of powdered detergents which differ from one another in detergency degree;

(b) discharging means operatively associated with the detergent container so that a powdered detergent contained therein is discharged to an area communicating to a washing member while in a washing operation;

(c) driving means for driving said discharging means so that said discharging means performs a detergent discharging operation;

(d) a first manually operated switch operatively associated with a plurality of displays corresponding to the respective degree of detergency of the powdered detergents to be selectively contained in the detergent container, said manually operated switch generating a signal in accordance with a desirable detergency degree when any one of the displays is selected;

(e) a second manually operated switch associated with a plurality of displays corresponding to degrees of soil of clothes to be washed, respectively, said second manually operated switch generating a signal in accordance with a desirable degree of soiling when any one of the displays is selected;

(f) control means comprising a microcomputer provided with a storage unit having a first data table for storing data corresponding to detergent feed amount in accordance with the respective detergency degrees of the detergents to be selectively contained in said detergent container, and a second detergent feed amount data table for storing data corresponding to detergent feed amount in accordance with the respective degrees of soil of clothes to be washed, said microcomputer operating to read the first and second data from the first and second data table in response to the signals supplied thereto from the first and second manually operated switches, respectively, thereby controlling the driving means so that the amount of detergent defined by the first and second data read out is discharged.

4. A detergent dispensing system for clothes washing machine or the like as set forth in claim 3, wherein said detergent discharging means comprises a coil member which is provided in a detergent discharging passageway for discharging the powdered detergent in the axial direction by screw action caused by rotation thereof when said detergent discharging means is driven by a drive means.

5. A detergent dispensing system for a clothes washing machine, comprising:

(a) a single detergent container for selectively containing one of a plurality of kinds of powdered detergents which differ from one another in detergency degree;

(b) discharging means operatively associated with the detergent container so that a powdered detergent contained therein is discharged to an area communicating to a washing member during a washing operation;

(c) driving means for driving said discharging means so that said discharging means performs a detergent discharging operation;

(d) a first manually operated switch operatively associated with a plurality of displays corresponding to the respective detergency degrees of the powdered detergents to be selectively contained in the detergent container, said manually operated switch generating a signal in accordance with a desirable detergency degree when any one of the displays is selected;

(e) a second manually operated switch operatively associated with a plurality of displays corresponding to degrees of soil of clothes to be washed, respectively, said second manually operated switch generating a signal in accordance with a desirable degree of soiling when any one of the displays is selected;

(f) a third manually operated switch operatively associated with a plurality of displays corresponding to respective water levels in the washing member, said third manually operated switch generating a signal in accordance with a desirable water level when any one of the displays is selected; and (g) control means comprising a microcomputer provided with a storage unit having a first data table for storing data corresponding to detergent feed amount in accordance with respective detergency degrees of the detergents to be selectively contained in the detergent container, a second data table for storing data corresponding to detergent feed amount in accordance with respective degrees of soil of clothes to be washed, and a third data table for storing data corresponding to detergent feed amount in accordance with respective water levels in the washing member, said microcomputer operating to read the first, second and third data from the first, second and third data tables, respectively, in response to the signals supplied thereto from the first, second and third manually operated switches, respectively, thereby controlling the driving means so that an amount of powdered detergent determined in accordance with the first, second and third data read out is discharged by the discharging means.

6. A detergent dispensing system for clothes washing machine or the like as set forth in claim 5, wherein said detergent discharging means comprises a coil member which is provided in a detergent discharging passageway for discharging the powdered detergent in the axial direction by screw action caused by rotation thereof when said detergent discharging means is driven by a driven means.

* * * * *